United States Patent [19]

Bock et al.

[11] 4,356,715

[45] Nov. 2, 1982

[54] METHOD AND DEVICE FOR STRAIGHTENING ELONGATED DRAWN ROUND STOCK

[75] Inventors: Erwin Bock; Walter Wetzels, both of Aachen, Fed. Rep. of Germany

[73] Assignee: Schumag GmbH, Aachen, Fed. Rep. of Germany

[21] Appl. No.: 186,118

[22] Filed: Sep. 11, 1980

[30] Foreign Application Priority Data

Sep. 18, 1979 [DE] Fed. Rep. of Germany ..... 2937635
May 30, 1980 [DE] Fed. Rep. of Germany ..... 3020536

[51] Int. Cl.[3] ..... B21D 3/02; B21D 3/04; B21F 1/02; B21B 19/12

[52] U.S. Cl. ..... 72/98; 72/99

[58] Field of Search ..... 72/79, 95, 98, 99, 100

[56] References Cited

U.S. PATENT DOCUMENTS

| | | | |
|---|---|---|---|
| 299,728 | 6/1884 | Brightman | 72/98 |
| 1,070,030 | 8/1913 | Haas | 72/98 |
| 1,977,223 | 10/1934 | Abramsen | 72/98 |
| 3,222,906 | 12/1965 | Aurin | 72/98 |
| 3,285,047 | 11/1966 | Crawford | 72/79 |
| 4,057,988 | 11/1977 | Tsukamoto | 72/99 |

*Primary Examiner*—Lowell A. Larson
*Attorney, Agent, or Firm*—Herbert L. Lerner; Laurence A. Greenberg

[57] ABSTRACT

Method for straightening elongated drawn round stock, which includes simultaneously advancing the stock in the longitudinal direction, rotating the stock about the longitudinal axis thereof and deflecting the stock from a straight line exceeding the yield point thereof in a straightening arc, and subjecting the surface of the stock to friction forces acting in the longitudinal direction during the deflection.

37 Claims, 19 Drawing Figures

METHOD AND DEVICE FOR STRAIGHTENING ELONGATED DRAWN ROUND STOCK

The invention relates to a method for straightening elongated drawn round stock by advancing it in the longitudinal direction and simultaneously rotating it about the longitudinal axis in a spiral feed and simultaneously imparting short-time deflection from a straight line, exceeding the yield point.

The invention also relates to a device for straightening elongated drawn round stock by means of straightening nozzles disposed in tandem and with drive discs or pulleys, for implementing the method.

The measures described hereinabove are based on the following phenomena:

Round stock which is cold-drawn in a drawing machine has internal stresses after the drawing which usually are tensile stresses at the outside and compression stresses in the core for reduction of more than 1.5%, for example. In the further processing of the material, these stresses are reduced in part, but the straightness of the material is impaired. A subsequent straightening operation is therefore necessary. This straightening operation is frequently combined with a polishing operation.

It is common to all straightening processes that the material is deformed, exceeding the yield point. Since in this deformation, the internal stresses are broken down in part, the cross section of the round stock becomes somewhat larger and the length of the round stock somewhat shorter. This is undesirable. It is therefore endeavored to carry out the straightening process as carefully as possible, in order to avoid unnecessary changes in shape during the straightening.

It is known to use a two-roll straightening machine with one hyperbolic and one cylindrical or parabolic roll. This machine simultaneously performs the polishing operation. Bars straightened and polished with this machine hold narrow tolerances even all the way to the end. For tubes which are only suited for smaller local forces, several two-roll straightening machines can be disposed in series, each machine only acting on the workpiece with a relatively small pressure.

The disadvantage of these machines is that the straightening and polishing effects cannot be separated and are therefore difficult to manage or to adjust together.

The heretofore-known measures according to the method described and to the device described at the outset work with at least three straightening nozzles disposed in tandem, through which the material passes while rotating about the longitudinal axis. The middle nozzle is laterally offset and thus causes the deflection from the straight line in a straightening arc, exceeding the yield point. The straightening nozzles are rotatably supported and are alternatingly inclined so that their openings are aligned with the pitch of the spiral feed, and as little friction as possible is produced in the passage. With this known measure, it was found that with adequate straightening the internal stresses are reduced greatly, whereby an impermissible increase of the cross section occurs. Furthermore, the beginning and the end of a rod to be straightened are not covered by the nozzles which forms a straightening triangle, and bent ends are obtained which become scrap. Additionally, these non-straightened ends have a certain amount of conicity.

It is accordingly an object of the invention to provide a method and device for straightening elongated drawn round stock, which overcomes the hereinafore-mentioned disadvantages of the heretofore-known methods and devices of this general type, and to carry out the straightening described hereinafore by short-time deflection from a straight line in a straightening arc, exceeding the yield point, in such a manner that the reduction of the internal stresses is minimized and that in the case of bars, even the ends are included in the straightening process.

With the foregoing and other objects in view there is provided, in accordance with the invention, a method for straightening elongated drawn round stock, which comprises simultaneously advancing the stock in the longitudinal direction, rotating the stock about the longitudinal axis thereof and briefly deflecting the stock from a straight line exceeding the yield point thereof in a straightening arc, and subjecting the surface of the stock to friction forces acting in the longitudinal direction during the deflection.

The device according to the invention for implementing the method according to the invention starts out from the known device with straightening nozzles disposed in series and with drive discs or pulleys, through which the material is moved forward as well as rotated about its axis.

In accordance with the apparatus of the invention, there is provided a device for straightening elongated drawn round stock, comprising drive disc means for simultaneously advancing the stock in the longitudinal direction thereof and rotating the stock about the longitudinal axis thereof, and rotatably supported straightening nozzles serially aligned in longitudinal direction of the stock in close sequence in a main straightening arc for deflecting the stock from a straight line exceeding the yield point thereof in the straightening arc and subjecting the surface of the stock to friction forces acting in the longitudinal direction during advancing rotating and deflecting.

Due to the fact that the straightening nozzles, according to the invention, are not inclined to be aligned with the spiral feed of the passing-through material but are aligned in the longitudinal direction, the friction forces acting in the longitudinal direction are produced while the material is deflected from the straight line in a straightening arc, exceeding the yield point. Due to the fact that the rotatably supported straightening nozzles are disposed in clos sequence one behind the other in the straightening arc, even the ends of the bar to be straightened are included in the straightening process.

It has been found that the application of the friction forces according to the invention in cooperation with the deflection from the straight line in a straightening arc reduces the internal stresses to a lesser degree than is the case with the above-described known measure. Therefore, one not only obtains rods which are straight over the entire length, but the change of the cross section in straightening is so small that one can speak of complete dimensional accuracy. In addition, the following advantage is provided: The drive discs pulleys by which the material is moved forward and is simultaneously rotated about its longitudinal axis, can be constructed in a known manner at the same time as polishing discs. Thus, separate adjustment is also obtained for the straightening and polishing according to the invention in a manner which is known and which can be controlled positively, contrary to the known method with the hyperbolic rolls mentioned above.

The magnitude of the friction forces is obtained in the average by the requirement that the power to be supplied for these friction forces should be about the same as the power to be spent on the short-time deflection from the straight line in the straightening arc, exceeding the yield point. The total power must therefore be about twice this amount. For rod diameters between about 6 and 22 mm, the machine must be constructed for about 70 kW, of which 35 kW go for the friction forces. For this larger power, however, rods are obtained which are completely straightened including the ends.

In accordance with another mode of the invention, there is provided a method which comprises distributing the friction forces over the length of the straightening arc.

In accordance with a further mode of the invention, there is provided a method which comprises applying the friction forces in close sequence. Through these measures, great uniformity in straightening is achieved.

In accordance with an added mode of the invention, there is provided a method which comprises superimposing shorter straightening arcs on the first-mentioned straightening arc.

In accordance with an additional mode of the invention, there is provided a method which comprises exceeding the yield point of the stock in the shorter straightening arcs as well. This measure makes it possible to fine-tune the stresses to each other due to the straightening forces and due to the friction forces.

In accordance with yet another mode of the invention, there is provided a method which comprises subjecting the surface of the stock to friction forces acting around the circumference thereof. Thereby, shape changes in the sense of unroundness of the material can be equalized.

In accordance with yet a further mode of the invention, there is provided a method which comprises selectively applying different friction forces independently of each other.

The following description refers to details of the device already described in general above, in accordance with the invention for implementing the method according to the invention.

The straightening nozzles, rotatably supported and disposed in close sequence with alignment in the longitudinal direction extend in their totality over the entire straightening arc or the entire main straightening arc. The main straightening arc is advantageously longer in the device according to the invention than in the known device described hereinafore with three straightening nozzles. The length of the straightening arc depends basically on the diameter of the material to be straightened. In the device according to the invention, the length of the main straightening arc is about 600 mm for a material diameter of 22 mm, with a deflection of about 6 mm. For a material diameter of 6 mm, the length of the main straightening arc in the device according to the invention is about 300 mm, with a deflection of likewise about 6 mm. In the above-mentioned known device, the length of the straightening arc is about 300 mm for a material diameter of 22 mm. It is seen from these differences that in straightening with the device according to the invention, the deflection from the straight line follows a somewhat slighter arc than with the known device. In the device according to the invention, the effect of the friction forces is added, whereby the straightening process overall yields very good straightness over the entire length of the bar, with the reduction of the internal stresses being smaller, so that good maintenance of tolerances is provided which can also be controlled by adjustment measures. Thirteen straightening nozzles may be distributed over the main straightening arc of about 600 mm. With the device according to the invention, the number of straightening nozzles is therefore substantially larger than with the above-mentioned known device with three straightening nozzles. In the known device, more than three straightening nozzles have also already been used. Because of the inclination of the nozzles in the known device, appreciable spacings between the nozzles were always necessary. In the device according to the invention with the straightening nozzles lined up in the lengthwise direction, the straightening nozzles can be placed close together, and, because they extend over the entire straightening arc, they also cover the ends of the bars to be straightened.

In accordance with another feature of the invention, the straightening nozzles are disposed along all of the straightening arc.

In accordance with a further feature of the invention, the straightening nozzles are laterally offset with respect to each other in the strengthening arc.

In accordance with an added feature of the invention, there are provided means for adjusting the lateral offset of the straightening nozzles for setting friction forces acting in the longitudinal direction.

In accordance with an additional feature of the invention, there are provided means for generating shorter straightening arcs being superimposed on the first-mentioned straightening arc. The inside diamater of the straightening nozzles may be appreciably larger than the material diameter. This makes it possible to adjust the friction forces on the one hand and the main straightening arc and the shorter straightening arcs on the other hand independently of each other.

In accordance with still another feature of the invention, there are provided means for braking the straightening nozzles for generating friction forces acting around the circumference of the stock to be straightened.

In accordance with still a further feature of the invention, the braking means are adjustable.

In accordance with still an added feature of the invention, there are provided means for setting at least one or more straightening nozzle at at least one end or both of the straightening arc for exclusively guiding thinner stock free of straightening pressure and shorten the straightening arc. In this manner, the device according to the invention can be adapted to different material diameters, and the optimum conditions can be adjusted in each case.

In accordance with still an additional feature of the invention, there are provided means for jointly adjusting all of the straightening nozzles.

In accordance with again another feature of the invention, there is provided a gauge being associated with the setting means and shaped according to the straightening arc. The gauge is formed according to the bending line of the material to be straightened. The gauge need be set only once for the correct share, and through the use of the gauge, the adjustment for extremely accurate straightening is available each time without great effort. The gauge need not be a straight edge but, in accordance with again a further feature of the invention the gauge includes distance transmitting means or setting devices for establishing a three-dimensional deflection of the stock.

In accordance with again an added feature of the invention, the gauge includes means for setting straightening pressure in accordance with an experimentally determined pressure profile.

In accordance with again an additional feature of the invention, the gauge is adjustable.

In accordance with yet another feature of the invention, there are provided means for adjusting the drive disc means for producing an adjustable spiral feed of the stock. The drive pulleys may be provided in a manner known per se in pairs ahead of and after the straightening section. In a likewise known manner, they can also act as polishing discs. With respect to the work piece, a feed spiral is obtained which involves, depending on the setting of the discs, a stronger rotary motion of the work piece with less longitudinal motion, or more longitudinal motion with less rotary motion.

The independent adjustability of the different functions in straightening and polishing, in addition to the precision obtained, is a great advantage over the known machine described above with the hyperbolic rolls.

The invention further relates to an additional improvement which is likewise, and in its own right, an invention.

For, practical tests have shown that when operating exclusively with straight nozzles with high friction, the friction is so great that the straightening process proper is impaired thereby. This is true particularly with larger dimensions of the material to be straightened. The power to be supplied is excessive, and the material becomes correspondingly hot, and the friction at the surface between the nozzle and the material is so great that the surface is damaged.

With the additional improvement, a good straightening process with smaller friction forces is obtained.

For this purpose, in accordance with the additional improvement of the invention, there is provided a method which comprises passing the stock through different phases in which relatively more deflection and less friction are simultaneously exerted and in which relatively less deflection and more friction are simultaneously exerted.

This improved control of the process allows independent application of the different measures which are intended for the straightening and are mutually complementary.

In accordance with another mode of the invention, there is provided a method which comprises adapting the deflection to the long-wave nonlinearities of the stock and only slightly exceeding the yield point under the straightening pressure during the phase having more deflection. The fact that the yield point is only exceeded a little causes only little reduction of the internal stresses and results in dimensional accuracy to a large extent.

In accordance with a further mode of the invention using the complementary nature of the improved method there is provided a method which comprises adapting the deflection to the short-wave nonlinearities of the stock during the phase having less deflection, and supplementing the straightening effect of the small straightening pressure with the friction forces during the phase having more deflection for adequate straightening.

In this manner, the friction forces can be kept so small that they are only a supplement for adequate straightening.

In accordance with an added mode of the invention, there is provided a method which comprises passing the stock through the phase with more deflection and less fricton first, and subsequently passing the stock through the phase with less deflection and more friction continuously to the end of the stock.

It is thereby achieved that the material is also straight at the ends.

In accordance with an additional mode of the invention, there is provided a method which comprises preceding the two first-mentioned phases with a phase having less deflection and more friction. In this manner, proper straightening is also obtained at the start of the material.

In accordance with the corresponding, improved device according to the invention for implementing the improved method, the straightening nozzles are in the form of nozzles disposed in different passage zones for simultaneously exerting more deflection and less friction and simultaneously exerting less deflection and more friction while continuously passing the stock through at least one straightening arc.

The straightening nozzles with more deflection and less friction are alternatingly inclined so that their openings are aligned with the pitch of the spiral feed. These nozzles are advantageously rotatably supported. The straightening nozzles with less deflection and more friction are aligned approximately in the longitudinal direction. These nozzles may also be supported rotatably. Through a combination of these passage zones, the desired effects regarding straightening with little reduction of the internal stresses and relatively small friction forces can be achieved.

In accordance with another feature of the invention, there are provided means for adjusting individual nozzles and nozzles within one of the zones.

In accordance with a further feature of the invention, there are provided setting means for adjusting the nozzles to exceed the yield point of the stock with minimum straightening pressure. This is important especially with heavier material. A separate adjusting device may be provided for this purpose.

In accordance with an added feature of the invention, there are provided separate setting means for adjusting the nozzles in the zones of more deflection. Otherwise, a combination with the previously-discusses features of the invention may be provided to advantage.

Especially advantageous is an embodiment of the improved device, in which a zone with less deflection and more friction forms the entrance of the straightening section, which is followed by a zone with more deflection and less friction and finally, again a zone with less deflection and more friction is provided which extends to the end of the bar to be straightened.

In accordance with an additional feature of the invention, at least one of the drive discs is a polishing disc.

In accordance with again another feature of the invention, there are provided means for controlling pressure exerted by the at least one polishing disc.

In accordance with again a further feature of the invention, at least one of the nozzles is a friction shoe exerting greater friction force than the other of the nozzles. Friction shoes are less expensive than nozzles with greater friction force. In addition, the friction force of the friction shoes can be controlled more accurately.

The different construction of the different zones and, above all things, the different distances of the straightening nozzle triangles substantially reduce the formation of feed spirals. Otherwise, in accordance with a concomitant feature of the invention, at least one of the nozzles is formed of nonferrous metal and exerts greater friction force than the other of the nozzles. Nonferrous metal has the property of providing a wider contact surface and of thereby decreasing the specific pressure after initially greater wear. In addition, the larger contact area produces additional relative friction which contributes to an improvement of the surface.

Other features which are considered as characteristic for the invention are set forth in the appended claims.

Although the invention is illustrated and described herein as embodied in a method and device for straightening elongated drawn round stock, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
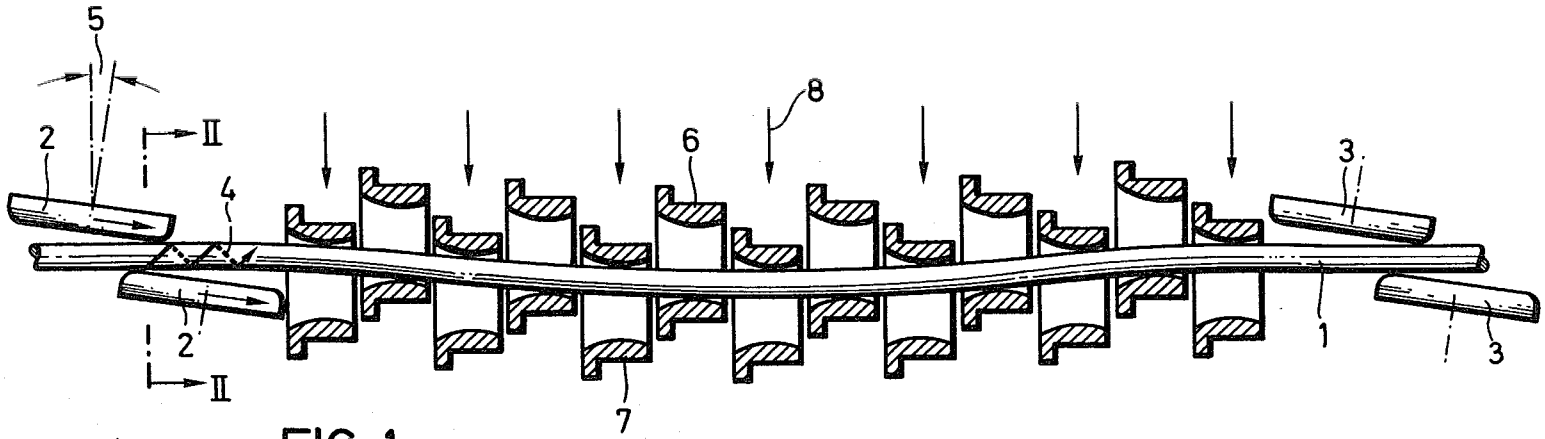
FIG. 1 is a fragmentary diagrammatic front-elevational view, partly in section, of the material passing through in the main straightening arc, with a presentation of the straightening nozzles disposed in accordance with the invention and with an illustration of the preceding and following drive and polishing discs.
Figure 2:
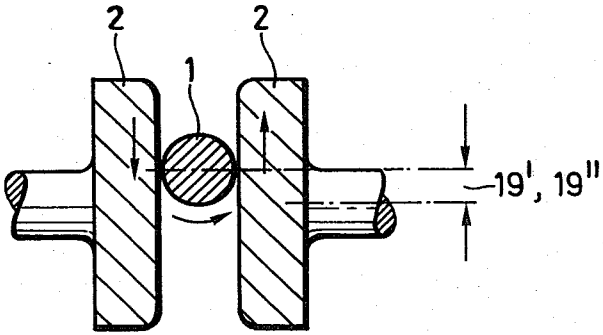
FIG. 2 is an enlarged, cross-sectional view taken along the line II—II in FIG. 1, in the direction of the arrows.

Referring now to the figures of the drawing and first particularly to FIGS. 1 and 2 thereof, it is seen that the material 1 passing through is advanced with rotation according to the feed spiral 4 by the drive and polishing discs or pulleys 2 and 3. The axes of the discs 2 and 3 are slightly inclined in a heretoforeknown manner by an angle 5. The straightening nozzles 7, which are offset downward, cause the material 1 to be deflected in the main straightening arc in accordance with the force action along the arrows 8. The straightening nozzles 6 cause no deflection but contribute to the friction acting in the longitudinal direction. The dot-dash lines 19' and 19'' in FIG. 2 indicate different heights at which the material can pass. This will be further discussed hereinbelow.

Figure 3:
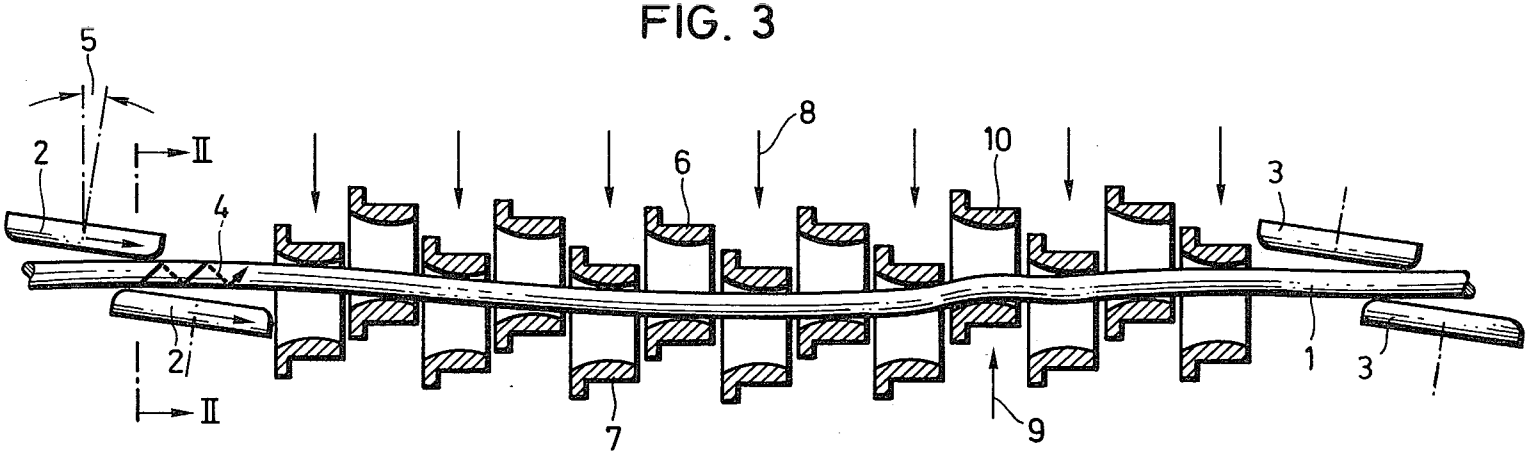
FIG. 3 is a view similar to FIG. 1, in which the material passes through a shorter straightening arc, in addition to the long main straightening arc.

According to FIG. 3, as compared to FIG. 1, a shorter straightening arc which is generated by the force action according to the arrow 9 and by the straightening nozzle 10, is further superimposed on the main straightening arc. Advantageously, a number of shorter straightening arcs is set.

Figure 4:
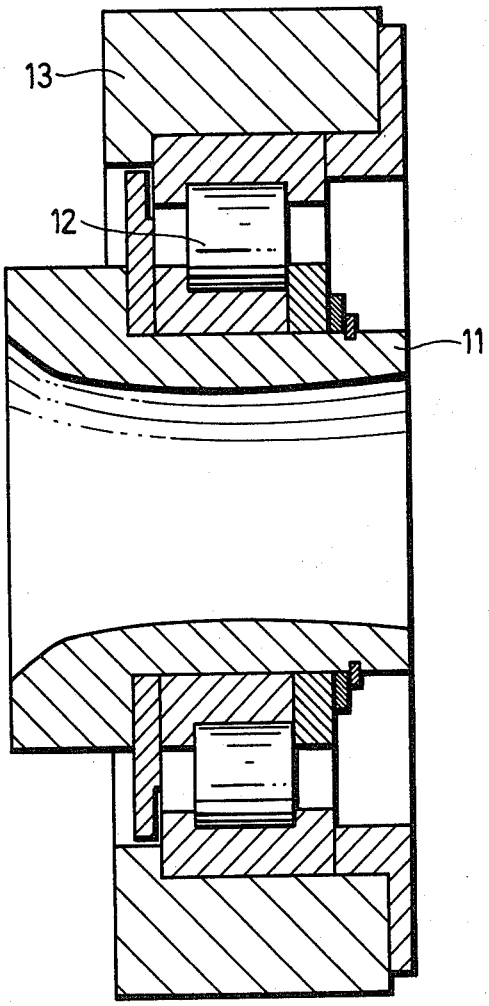
FIG. 4 is a further enlarged diagrammatic cross-sectional view through a rotatably-supported straightening nozzle.

FIG. 4 shows how the straightening nozzle 11 is fastened in an outer mounting 13 by means of a roller bearing 12. This mounting 13 can be displaced transversely to the longitudinal direction in accordance with the desired straightening force and/or friction force in the longitudinal direction.

Figure 5:
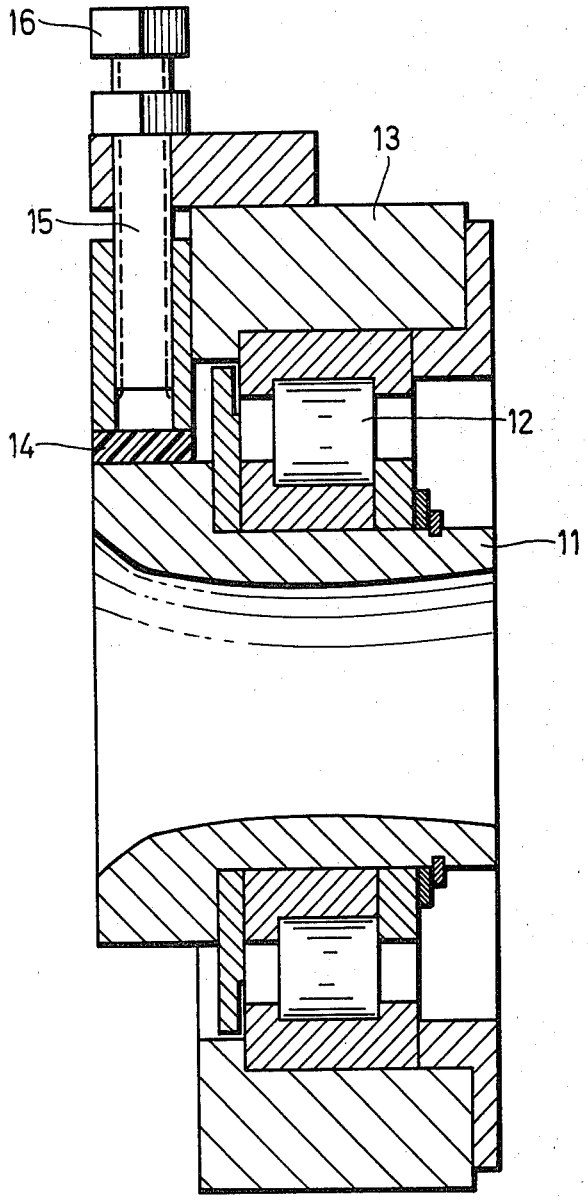
FIG. 5 is a view similar to FIG. 4 of a cross-section through a rotatably supported straightening nozzle with adjustable braking means.

According to FIG. 5, the rotation of the straightening nozzle 11 can be braked by braking means 14 which can be adjusted by means of the screw 15, 16. Friction forces which act around the circumference of the material to be straightened can therefore also be generated.

Figure 6:
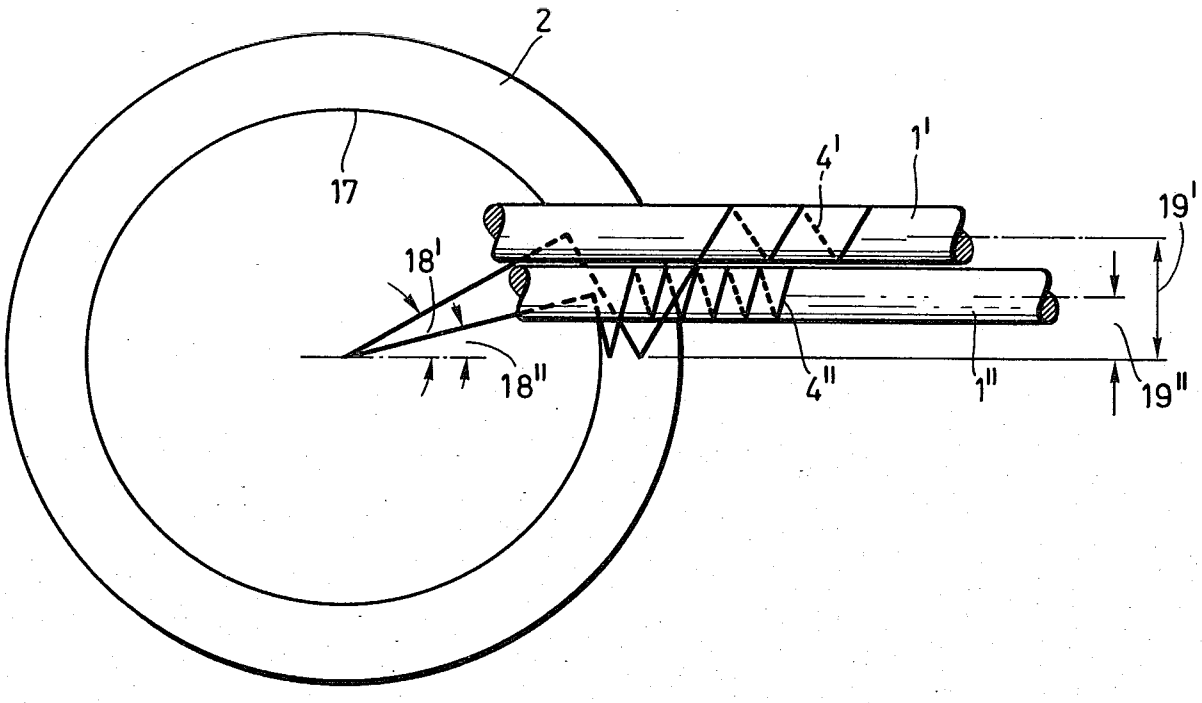
FIG. 6 is a fragmentary diagrammatic front-elevational view of the adjustment of the spiral feed.

FIG. 6 shows in a diagrammatic manner the adjustability of the feed spiral. Because of the inclined position 5 (see FIG. 1), the drive disc 2 has a working circle 17 which is somewhat removed from the rim thereof. Depending on the height at which the material 1' or 1'' passes through (angle 18' or 18'' and height 19' or 19'', also seen in FIG. 2), a different feed spiral 4' or 4'' is obtained. In the following figures the material 101 passing through to be straightened moves according to the feed spiral 104. This motion is generated by the drive discs 102 and 103, which may also be constructed as polishing discs.

Figure 7:
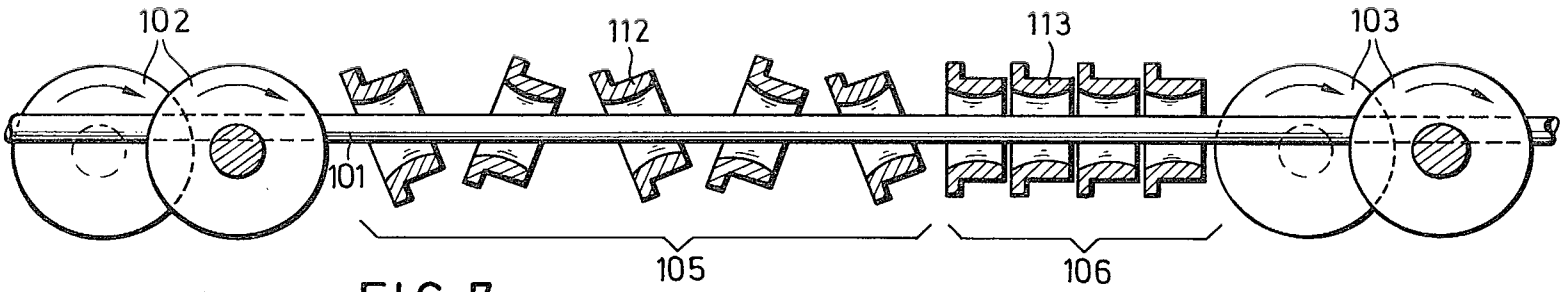
FIG. 7 is a fragmentary diagrammatic front-elevational view, partly in section, of an overall device for straightening in accordance with an additional feature of the invention and an improvement with a passage zone, formed by five straightening nozzles with more deflection and less friction and subsequently a zone with four straightening nozzles with less deflection and more friction.
Figure 8:
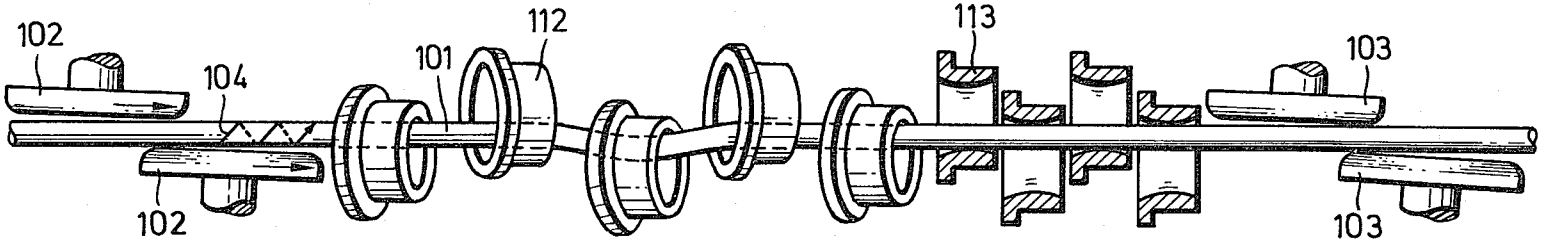
FIG. 8 is a top plan view, partly in section, onto the device according to FIG. 7.

According to FIGS. 7 and 8, the material passes through the passage zones 105 and 106. The passage zone 105 has straightening nozzles 112, the openings of which are lined up with the pitch or slope of the feed spiral 104. These straightening nozzles cause a greater deflection of the material 101 passing through with less friction. In one preferred embodiment, the zone 105 has five straightening nozzles 112.

Zone 106 contains straightening nozzles 113 aligned in the longitudinal direction. These straightening nozzles provide less deflection with more friction. Shown are, for instance, four straightening nozzles 113.

Figure 9:
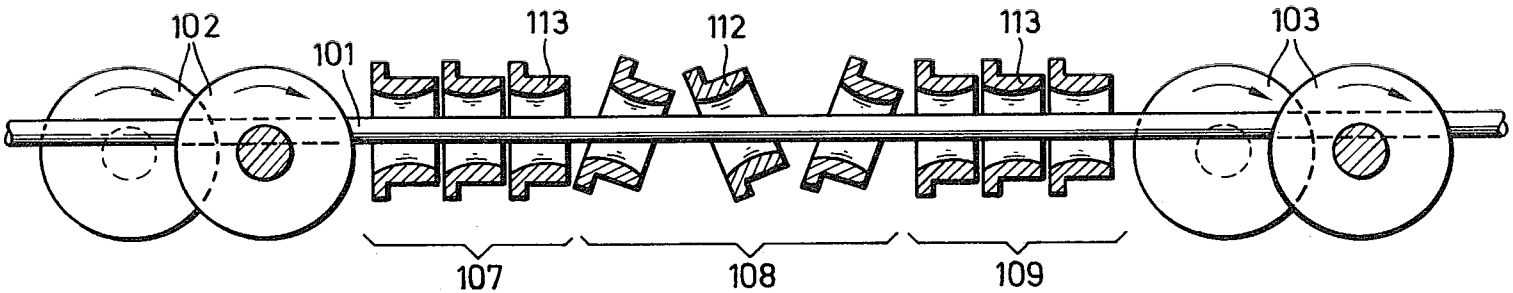
FIGS. 9 and 10 are top plan views onto the devices according to FIGS. 7 and 8 but with an initial passage zone with three nozzles with less deflection and more friction, a passage zone following thereupon with three nozzles with more deflection and less friction and finally, with a passage zone with three nozzles with less deflection and more friction.
Figure 10:
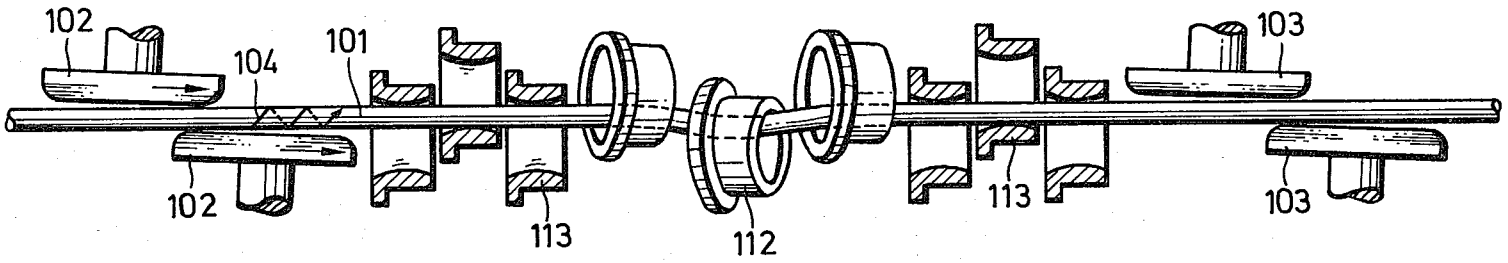

According to FIGS. 9 and 10, the material 101 passes through three zones 107, 108 and 109. In zone 108, three straightening nozzles 113 are provided which are aligned in the longitudinal direction and cause less deflection with more friction. In zone 108, three straightening nozzles 112 are provided, the openings of which are lined up with the slope of the feed spiral 104. These straightening nozzles cause more deflection with less friction. In zone 109, three straightening nozzles 113 are again provided which are aligned in the longitudinal direction and cause less deflection with more friction.

The overall arrangement of the zones 107, 108 and 109 has been found to be particularly advantageous. On the one hand, sufficient straightening action is obtained with this arrangement. On the other hand, the reduction of the internal stresses is so small that practically perfect dimensional accuracy is provided in straightening. Bent ends are also avoided, so that there is no material waste. The number of the nozzles 112 and 113 in FIGS. 9 and 10 is given only by way of example; other amounts can also be considered, especially depending on the type of material 101 which is passed therethrough.

Figure 11:
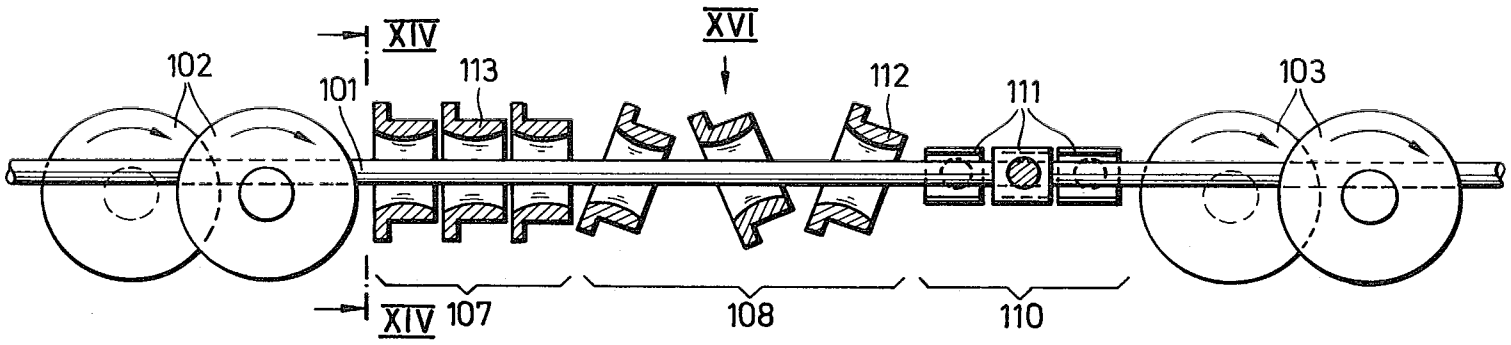
FIGS. 11 and 12 are a side view and a top plan view of the devices according to FIGS. 9 and 10, where, however, the zone at the exit with three nozzles of greater friction and less deflection is replaced by a zone with three friction shoes.
Figure 12:
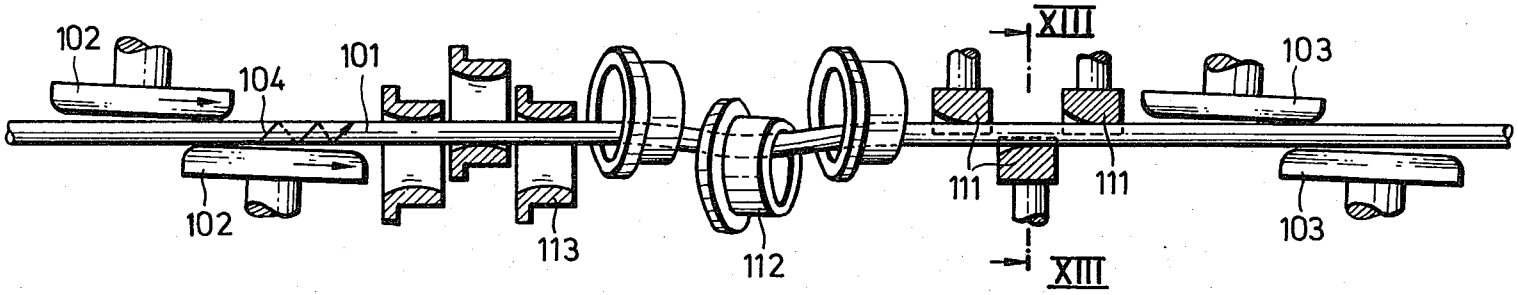
Figure 13:
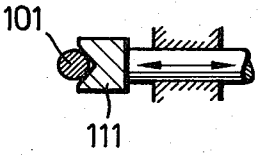
FIG. 13 is a cross-sectional view of an individual friction shoe taken along the line XIII—XIII in FIG. 12, in the direction of the arrows.

In FIGS. 11, 12 and 13, the zone 109 shown in FIGS. 9 and 10 is designated as zone 110 with friction shoes 111 instead of with nozzles 113. These friction shoes are of simpler construction than the nozzles 113. The friction obtained thereby is adjustable, along the double-headed arrow shown in FIG. 13.

Different setting possibilities, even with respect to the nozzles 112, are shown in FIGS. 14 to 17. The setting is performed along the arrows 117, 123 and 118 in FIGS. 14, 16 and 18, respectively.

Figure 14:
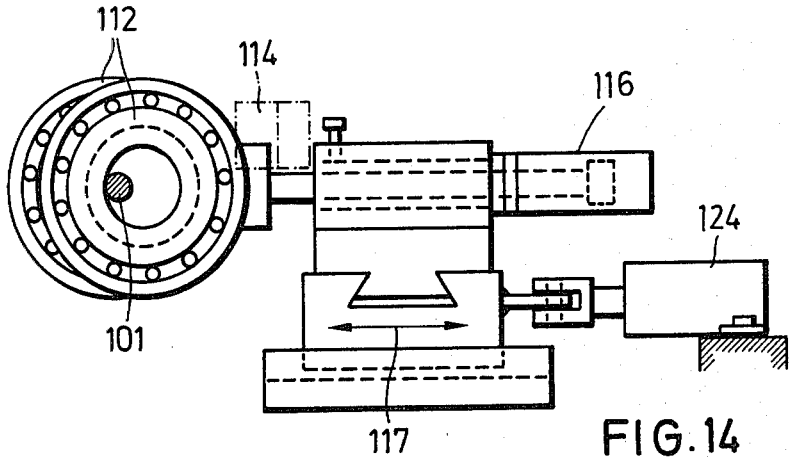
FIG. 14 is a cross-sectional view taken along the line XIV—XIV in FIG. 11 in the direction of the arrows, with an adjusting device for the zone and/or the nozzles within the zone, and a gauge for adjustment.
Figure 15:
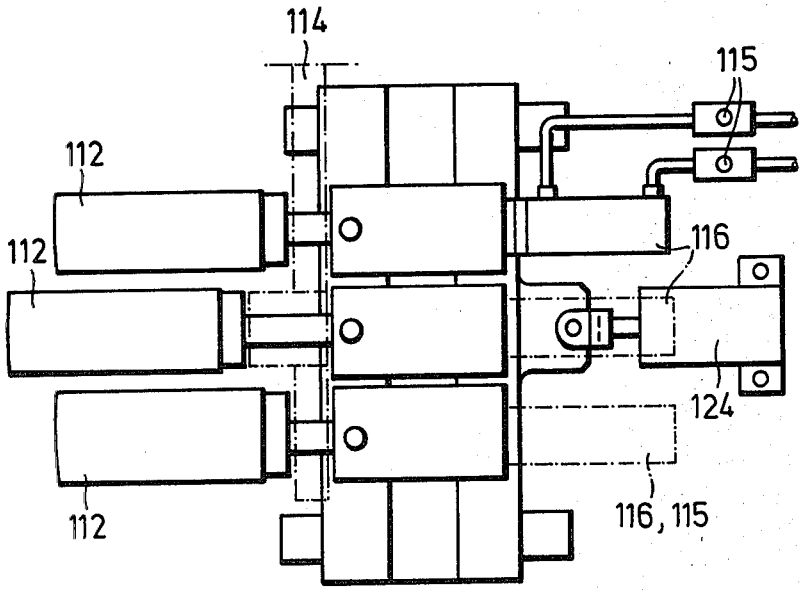
FIG. 15 is a diagrammatic front-elevational view of a gauge for adjusting and details of the setting device.
Figure 16:
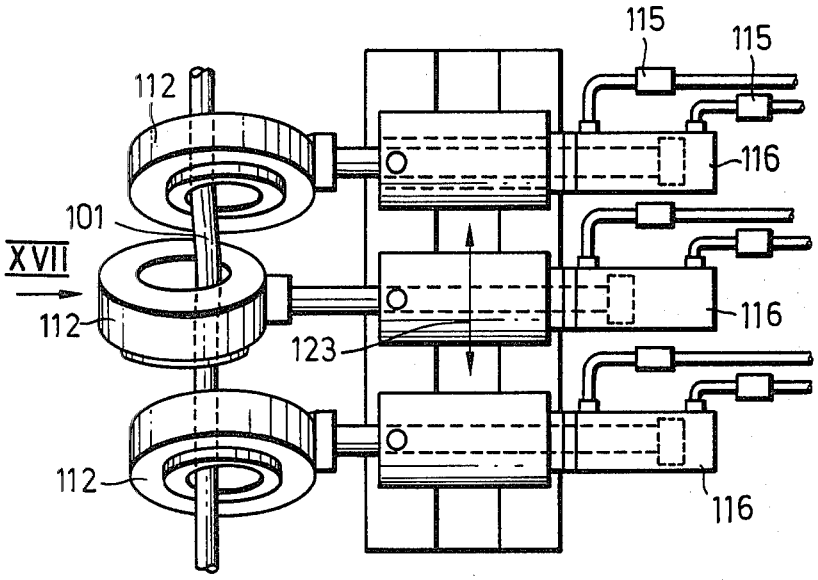
FIG. 16 is a top plan view taken along the line XVI in FIG. 11 in the direction of the arrow, with a view of the setting device.
Figure 17:
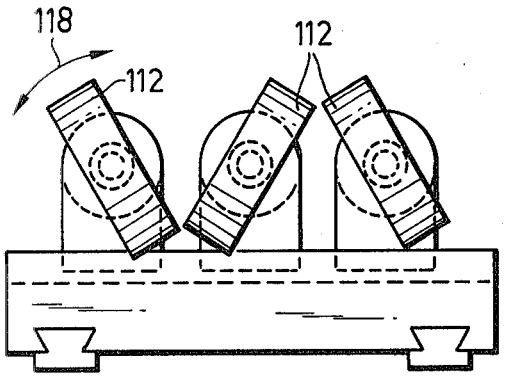
FIG. 17 is a side elevational view taken along the line XVII in FIG. 16, in the direction of the arrow.

Reference numeral 114 shown in FIGS. 14 and 15 is a gauge for setting, which may optionally act jointly on several nozzles 112 in FIGS. 14–17. An adjustable pressure limiter 115 shown in FIGS. 15 and 16 is used for setting the straightening pressure. Reference numeral 116 in the figures refers to a cylinder for adjusting a nozzle 112. A device 124 for jointly setting an entire group nozzles 112, is also shown. Accordingly the nozzle 112, or other nozzles shown in the previous figures, are adjustable by the gauge 114 and cylinders 116 through action of the adjustable pressure limiter 115 or device 124.

Figure 18:
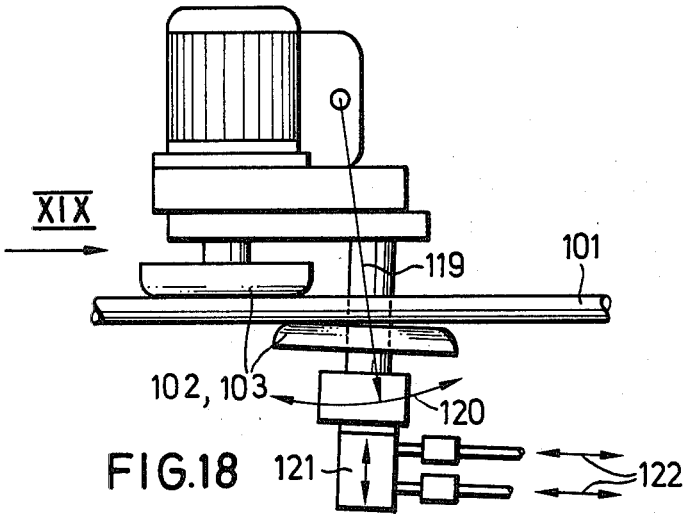
FIG. 18 is a diagrammatic front-elevational view of a drive pulley constructed as a polishing disc with a setting and pressure control device.
Figure 19:
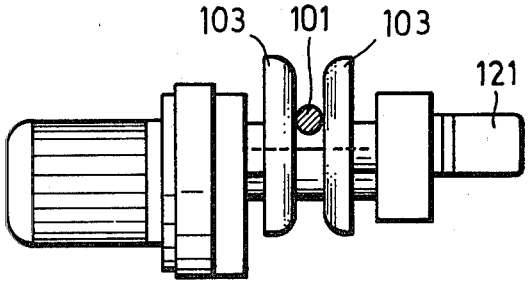
FIG. 19 is a side-elevational view, taken along the line XIX in FIG. 18 in the direction of the arrow.

If the drive discs 102, 103 are constructed as polishing discs, adjusting devices according to FIGS. 18 and 19 are advantageously provided. The pressure can be controlled with the device 121 along the arrow shown therein and along the arrow 122. The feed spiral 104 can be changed by operating the lever 119 according to placement along the arrow 120, so as to alter the polishing angle of the discs 102, 103 run by the motor shown above.

There are claimed:

1. Method for straightening elongated drawn round stock, which comprises simultaneously advancing the stock in the longitudinal direction, rotating the stock about the longitudinal axis thereof and deflecting the stock from a straight line exceeding the yield point thereof in a straightening arc, subjecting the surface of the stock to friction forces acting in the longitudinal direction during the deflection, and superimposing shorter straightening arcs on the first-mentioned straightening arc.

2. Method according to claim 1, which comprises distributing the friction forces over the length of the straightening arc.

3. Method according to claim 2, which comprises applying the friction forces in close sequence.

4. Method according to claim 1, which comprises exceeding the yield point of the stock in the shorter straightening arcs as well.

5. Method according to claim 1, which comprises subjecting the surface of the stock to friction forces acting around the circumference thereof.

6. Method according to claim 1, which comprises selectively applying different friction forces independently of each other.

7. Method for straightening elongated drawn round stock, which comprises simultaneously advancing the stock in the longitudinal direction, rotating the stock about the longitudinal axis thereof and deflecting the stock from a straight line exceeding the yield point thereof in a straightening arc, subjecting the surface of the stock to friction forces acting in the longitudinal direction during the deflection, and passing the stock through different phases in which relatively more deflection and less friction are simultaneously exerted and in which relatively less deflection and more friction are simultaneously exerted.

8. Method according to claim 7, which comprises adapting the deflection to the long-wave nonlinearities of the stock and only slightly exceeding the yield point under the straightening pressure during the phase having more deflection.

9. Method according to claim 7, which comprises adapting the deflection to the short-wave nonlinearities of the stock during the phase having less deflection, and supplementing the straightening effect of the small straightening pressure with the friction forces during the phase having more deflection for adequate straightening.

10. Method according to claim 7, 8 or 9, which comprises passing the stock through the phase with more deflection and less friction first, and subsequently passing the stock through the phase with less deflection and more friction continuously to the end of the stock.

11. Method according to claim 10, which comprises preceding the two first-mentioned phases with a phase having less deflection and more friction.

12. Device for straightening elongated drawn round stock, comprising drive disc means for simultaneously advancing the stock in the longitudinal direction thereof and rotating the stock about the longitudinal axis thereof, and rotatably supported straightening nozzles serially aligned in longitudinal direction of the stock in close sequence in a straightening arc for deflecting the stock from a straight line exceeding the yield point thereof in said straightening arc and subjecting the surface of the stock to friction forces acting in the longitudinal direction during advancing rotating and deflecting.

13. Device according to claim 12, wherein said straightening nozzles are disposed along all of said straightening arc.

14. Device according to claim 12, wherein said straightening nozzles are laterally offset with respect to each other in said straightening arc.

15. Device according to claim 14, including means for adjusting the lateral offset of said straightening nozzles for setting friction forces acting in the longitudinal direction.

16. Device according to claim 14 or 15, including means for generating shorter straightening arcs being superimposed on said first-mentioned straightening arc.

17. Device according to claim 12, including means for braking said straightening nozzles for generating friction forces acting around the circumference of the stock.

18. Device according to claim 17, wherein said braking means are adjustable.

19. Device according to claim 16, including means for setting at least one straightening nozzle at at least one end of said straightening arc for exclusively guiding thinner stock free of straightening pressure and shorten said straightening arc.

20. Device according to claim 13, 14, 15, 17 or 18, including means for setting at least one straightening nozzle at at least one end of said straightening arc for exclusively guiding thinner stock free of straightening pressure and shorten said straightening arc.

21. Device according to claim 15, including means for jointly adjusting all of said straightening nozzles.

22. Device according to claim 16, including means for jointly adjusting all of said straightening nozzles.

23. Device according to claim 18, including means for setting at least one straightening nozzle at at least one end of said straightening arc for exclusively guiding thinner stock free of straightening pressure and shorten said straightening arc and means for jointly adjusting all of said straightening nozzles.

24. Device according to claim 23, including a gauge being associated with said setting means and shaped according to said straightening arc.

25. Device according to claim 24, wherein said gauge includes distance transmitting means for establishing a three-dimensional deflection of the stock.

26. Device according to claim 24, wherein said gauge includes means for setting straightening pressure in accordance with an experimentally determined pressure profile.

27. Device according to claim 24, 25 or 26, wherein said gauge is adjustable.

28. Device according to claim 12, including means for adjusting said drive disc means for producing an adjustable spiral feed of the stock.

29. Device according to claim 12, wherein said straightening nozzles are in the form of nozzles disposed in different passage zones for simultaneously exerting more deflection and less friction and simultaneously exerting less deflection and more friction.

30. Device according to claim 29, including means for adjusting individual nozzles and nozzles within one of said zones.

31. Device according to claim 30, including setting means for adjusting said nozzles to exceed the yield point of the stock with minimum straightening pressure.

32. Device according to claim 30, including separate setting means for adjusting said nozzles in said zones of more deflection.

33. Device according to claim 24, 25, 26, or 28, wherein said straightening nozzles are disposed in different passage zones for simultaneously exerting more deflection and less friction and simultaneously exerting less deflection and more friction, and including means for adjusting individual nozzles and nozzles within one of said zones, and means for setting said nozzles to exceed the yield point of the stock with minimum straightening pressure in said zones of more deflection.

34. Device according to claim 33, wherein at least one of said drive discs is a polishing disc.

35. Device according to claim 34, including means for controlling pressure exerted by said at least one polishing disc.

36. Device according to claim 29, wherein at least one of said nozzles is a friction shoe exerting greater friction force than the other of said nozzles.

37. Device according to claim 29, wherein at least one of said nozzles is formed of non-ferrous metal and exerts greater friction force than the other of said nozzles.

* * * * *